US007545355B2

(12) United States Patent
Akimoto et al.

(10) Patent No.: US 7,545,355 B2
(45) Date of Patent: Jun. 9, 2009

(54) IMAGE DISPLAY APPARATUS AND DRIVING METHOD THEREOF

(75) Inventors: Hajime Akimoto, Oume (JP); Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 472 days.

(21) Appl. No.: 09/834,919

(22) Filed: Apr. 16, 2001

(65) Prior Publication Data

US 2002/0047826 A1 Apr. 25, 2002

(30) Foreign Application Priority Data

Sep. 6, 2000 (JP) ..... 2000-274992

(51) Int. Cl.
*G09G 3/36* (2006.01)

(52) U.S. Cl. ..... 345/87

(58) Field of Classification Search ..... 345/208, 345/204, 30–104; 349/41–49
See application file for complete search history.

(56) References Cited

U.S. PATENT DOCUMENTS

| | | | | | |
|---|---|---|---|---|---|
| 5,471,225 | A * | 11/1995 | Parks | 345/98 |
| 5,583,533 | A * | 12/1996 | Moriyama | 345/94 |
| 5,594,464 | A * | 1/1997 | Tanaka et al. | 345/94 |
| 5,627,557 | A * | 5/1997 | Yamaguchi et al. | 345/90 |
| 5,838,187 | A * | 11/1998 | Embree | 327/512 |
| 6,046,716 | A * | 4/2000 | McKnight | 345/95 |
| 6,175,351 | B1 * | 1/2001 | Matsuura et al. | 345/98 |
| 6,335,716 | B1 * | 1/2002 | Yamazaki et al. | 345/92 |
| 6,426,594 | B1 * | 7/2002 | Ito | 315/169.1 |
| 6,611,261 | B1 * | 8/2003 | Zhang et al. | 345/204 |
| 6,642,915 | B1 * | 11/2003 | Booth et al. | 345/90 |

* cited by examiner

*Primary Examiner*—Srilakshmi K Kumar
(74) *Attorney, Agent, or Firm*—Antonelli, Terry, Stout & Kraus, LLP.

(57) ABSTRACT

In an image display apparatus having a memory function of image data, the power consumption is reduced. This effect can be attained by providing each DRAM memory cell with an amplifying FET.

13 Claims, 13 Drawing Sheets

IMAGE DISPLAY APPARATUS AND DRIVING METHOD THEREOF

BACKGROUND OF THE INVENTION

The present invention relates to a liquid crystal image display apparatus; and, more particularly, the invention relates to a liquid crystal image display apparatus which can display an image with low power consumption.

A conventional image display apparatus will be described with reference to FIG. 19, which is a diagram showing the construction of a TFT liquid crystal panel using conventional technology. Pixels 100 each having a liquid crystal capacitor 101 and a pixel switch 102 are arranged in the form of a matrix, and a gate of the pixel switch 102 is connected to a gate line shift register 104 through a gate line 103. Further, a drain of the pixel switch 102 is connected to a DA converter 106 through a signal line 105. On the other hand, each of memory cells of a frame memory arranged in the form of a matrix is composed of a memory capacitor 111 and a memory switch 112, and a gate of the memory switch is connected to a word line shift register 114 through a word line 113 and a word line selection switch 115 arranged at the end of the word line. On the other hand, one end of each of the memory switches is connected to a data line 116. A data input circuit 117 is arranged at one end of the data line 116, and a sense amplifier 108 and a latch circuit 107 are arranged at the other end of the data line 116. An output of the latch circuit 107 is connected to the DA converter 106. The above-described constituent elements are formed using poly-Si TFT on a single substrate.

The operation of the TFT liquid crystal panel will be described. At the time of writing, image data from the data input circuit 117 is written in the memory cells on a row selected by the word line shift register 114 and the word line selection switch 115, similar to a general DRAM (dynamic random access memory). Similarly, the image data of the memory cells on the row selected by the word line shift register 114 and the word line selection switch 115 is input to the sense amplifier 108 through the data line 116 so as to be latched by the latch circuit 107. The latched image data is converted to an analogue signal by the DA converter 106 and is output to the signal line 105. At that time, the gate line shift register 104 is scanned in synchronism with the word line shift register 114, and the gate line shift register 104 sets the pixel switch 102 on a given row to the ON-state through the gate line 103. Thereby, the analogue signal is written in the liquid crystal capacitor 101 of the given pixel 100, and, accordingly, the image can be displayed using the liquid crystal based on the read-out image data.

The above-described apparatus is described in detail, for example, in Japanese Patent Application Laid-open No. 11-85065 (1999).

According to the conventional technology described above, by driving the word line 113 of the frame memory and the gate line 103 of the pixel portion with an equal driving frequency, it is possible to avoid interference noise caused by leaking of a word line clock signal of the frame memory into the displayed image. However, low power consumption of the image display apparatus is not sufficiently taken into consideration. This problem will be described below.

From the viewpoint of improving the yield by reducing the area and the number of pixels, the frame memory is not formed by a SRAM (static random access memory), but is typically formed by a DRAM, as described above. However, when a general DRAM cell structure, which is typically composed of one transistor and one capacitor, is used, a circuit having a large penetration current can not help being employed as the sense amplifier 108, because it is necessary to amplify a very small signal below several tens mV. This is a big problem from the viewpoint of low power consumption of the device.

Further, from the viewpoint of driving the DRAM cell, in contrast to the conventional example in which writing, refreshing and reading are separately considered, power consumption must be further reduced by organically combining writing, refreshing and reading or by modifying the driving method.

SUMMARY OF THE INVENTION

According to an embodiment in accordance with the present invention, an image display apparatus comprises a plurality of display pixels arranged in the form of a matrix in order to perform image display, the display pixels each having a pixel electrode and a pixel switch connected to the pixel electrode in series; a plurality of memory elements for storing display data; an image signal generating means for outputting a given image signal based on the display data; a group of signal lines for connecting the image signal generating means to the group of pixel switches; and a display image selection means for writing the image signal in a given display pixel through the group of signal lines and the group of pixel switches. Each basic unit of the memory element comprises a memory switch; a memory capacitor connected to the memory switch; an amplifier FET having a gate which is connected to the memory capacitor; and a refreshing operation means for performing a preset refreshing operation on a signal charge stored in the memory capacitor.

After the introduction of 4 kbit-DRAM products into the market, employment of (one transistor+one capacitor) cells has become general in the field of DRAM design in order to make the dimension of the memory cell as small as possible. On the other hand, the idea of the above-mentioned construction of a memory cell is effective for an image display apparatus which needs to achieve a power saving and be small area compatible.

According to an embodiment in accordance with the present invention, in an image display apparatus that comprises a plurality of display pixels arranged in the form of a matrix in order to perform image display, the display pixels each having a pixel electrode and a pixel switch connected to the pixel electrode in series; an image signal generating means for outputting a given image signal based on display data, the image signal generating means having a plurality of memory elements for storing the display data; a group of signal lines for connecting the image signal generating means to the group of pixel switches; and a display image selection means for writing the image signal in a given display pixel through the group of signal lines and the group of pixel switches; and, in which each basic unit of the memory element comprises a memory switch; a memory capacitor connected to the memory switch; and a refreshing operation means for performing a preset refreshing operation on a signal charge stored in the memory capacitor; the method of driving the image display apparatus includes reading the display data from the memory element during the refreshing operation to the memory element using the refreshing operation means.

DETAILED DESCRIPTION OF THE PREFERRED EMBODIMENTS

Embodiment 1

A first embodiment in accordance with the present invention will be described with reference to FIG. 1 to FIG. 8 and Table 1 and table 2.

Figure 1:
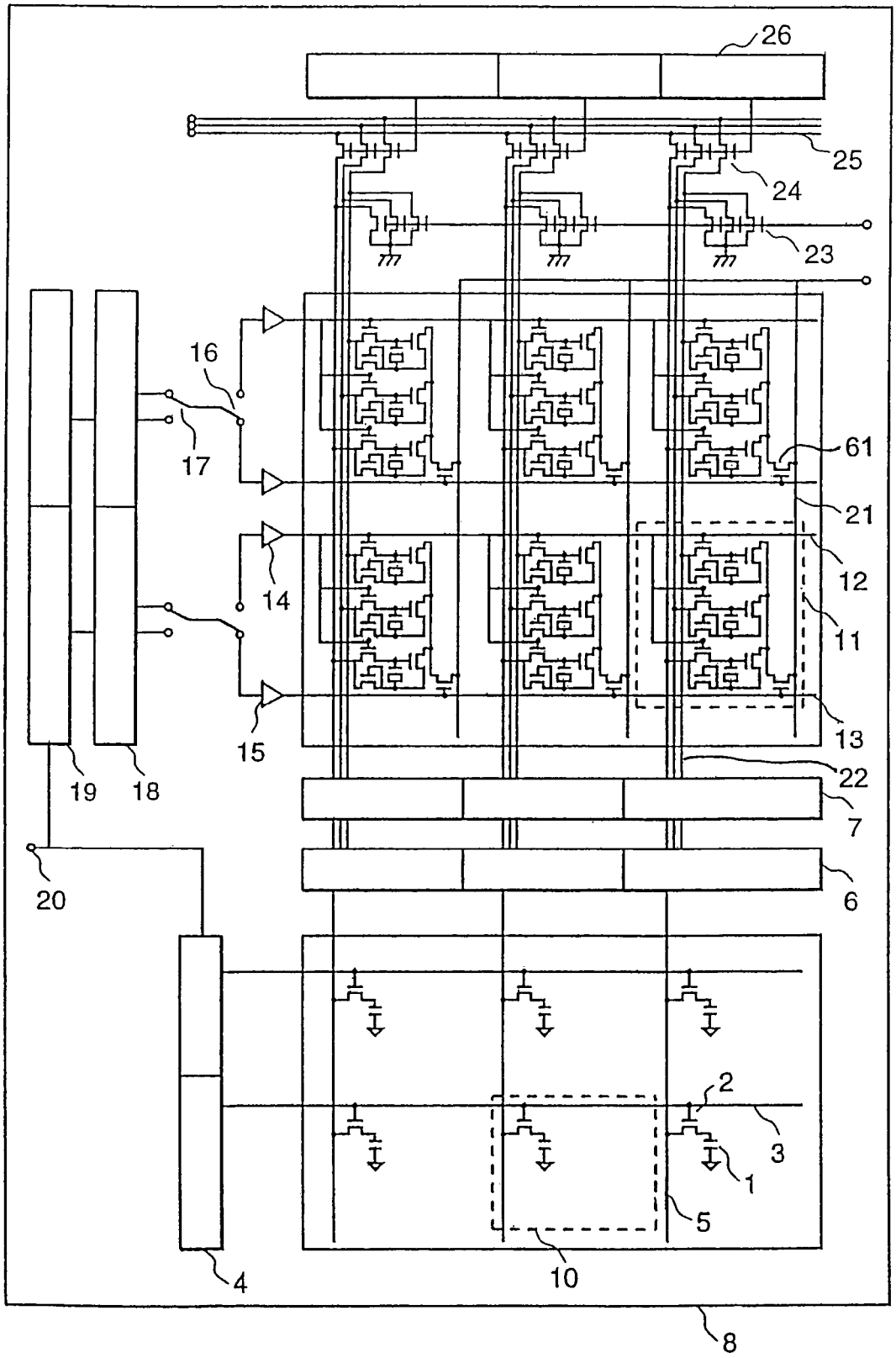
FIG. 1 is a schematic diagram showing the construction of a first embodiment of a liquid crystal display panel.

Initially, the construction of the present embodiment will be described. FIG. 1 is a diagram showing the construction of the embodiment of a polycrystalline Si-TFT liquid crystal display panel.

Pixels 10 each having a liquid crystal capacitor 1 and a pixel switch 2 are arranged in the form of a matrix, and the gate of the pixel switch 2 is connected to a gate line register 4 through a gate line 3. The drain of the pixel switch 2 is connected to a DA converter 6 through a signal line 5. On the other hand, each of the memory cells 11 of a frame memory arranged in the form of a matrix is connected to a word line 12 and read-out line 13, both extending in the x-axis direction, and data lines 22 and a common drain line 21, both extending in the y-axis direction. Therein, a word line buffer 14 is arranged at one end of the word line 12, and a read-out line buffer 15 is arranged at one end of the read-out line 13; and, a memory y-address decoder 18 and a memory shift register 19 are selectively connected to both buffers. The word line buffer 14 and the read-out line buffer 15 each are selectively accessed by the buffer selection switch 16, and the memory y-address decoder 18 and the memory shift register 19 are selectively accessed by the address selection switch 17. On the other hand, a data line reset circuit 23 and a data line input switch 24 are arranged at one end of the data line 22; the other end of the data line input switch 24 is connected to a data line input line 25; and the gate of the data line input switch 24 is connected to a memory x-address decoder 26. On the other hand, a latch circuit 7 is arranged at the other end of the data line 22, and the output of the latch circuit 7 is input to the DA converter 6 through a data line 22B. Therein, the gate line shift register 4 and the memory shift register 19 are driven by a clock pulse from a common input terminal 20.

Each of the constituent elements described above is formed on a single glass substrate using poly-Si TFT, and a CMOS switch constructed using a polycrystalline Si TFT is employed for each of the switches. Here, a description of the structures necessary for forming the TFT panel, such as a color filter, a back light structure, etc. will be omitted for the sake of simplifying the description.

Figure 2:
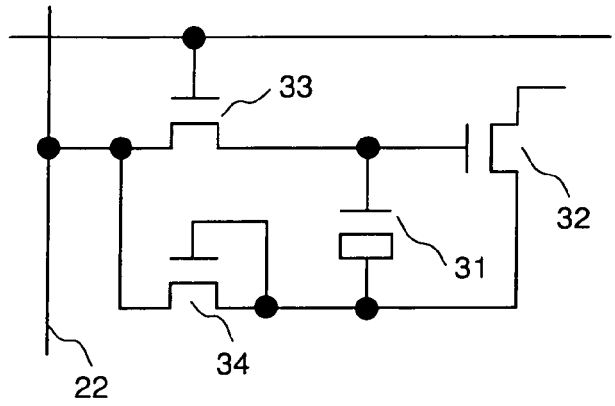
FIG. 2 is a circuit diagram showing the circuit of a basic unit of a memory cell in the first embodiment.

FIG. 2 is a diagram showing the circuit structure of a basic unit of the memory cell 11. A memory switch 33, having a gate which is connected to the word line 12, is arranged in the data line 22, and the other end of the memory switch 33 is connected to a memory capacitor 31 and the gate of a memory amplifier 32. The source of the memory amplifier 32 is connected to the other end of the memory capacitor 31 and at the same time to an output switch 34. The output switch 34 is a diode-connected n-channel poly-Si TFT, and the other end of the output switch 34 is connected to the data line 22. Further, the memory capacitor 31 is also an n-channel poly-Si TFT, and the channel side is on the source side of the memory amplifier 32. The memory cell 11 is composed of three basic units, as shown in FIG. 2, but this is because the image data handled here is 3, bits.

The construction of the latch circuit 7 will be described with reference to FIG. 3, FIG. 4 and Table 1.

Figure 3:
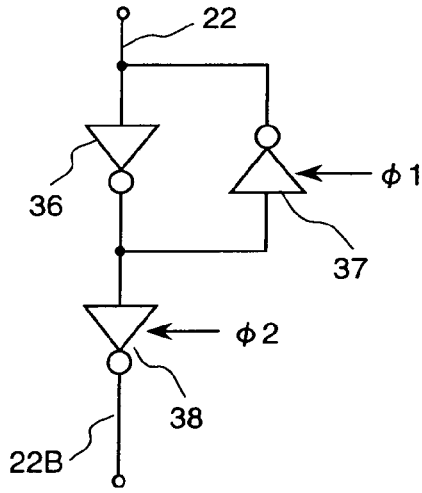
FIG. 3 is a circuit diagram showing the construction of a single unit of a latch circuit in the first embodiment.

FIG. 3 is a diagram showing the construction of a single unit of the latch circuit which is arranged in the end portion of the data line 22. The data line 22 is connected to a CMOS inverter 36, and the output of the CMOS inverter 36 is connected to a clocked inverter 37 driven by a signal pulse $\phi$1 and to a clocked inverter 38 driven by a signal pulse $\phi$2. Further, the output of the clocked inverter 37 is fed back to the data line 22, and the clocked inverter 38 outputs to the data line 22B.

Figure 4:
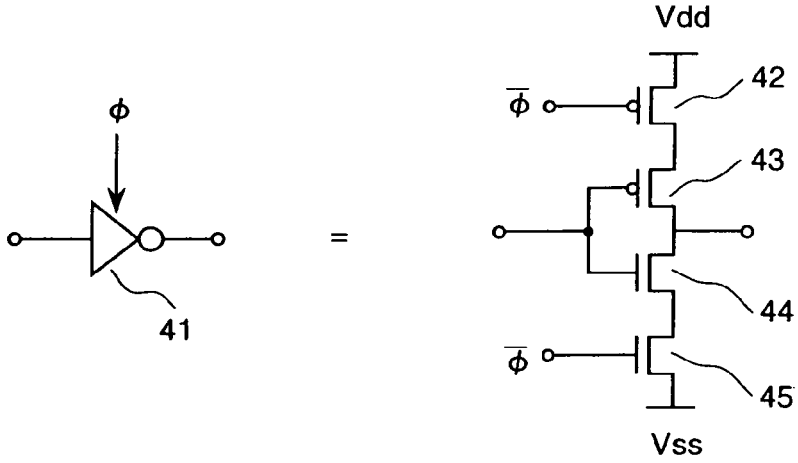
FIG. 4 is a circuit diagram showing the circuit of a clocked inverter in the first embodiment.

FIG. 4 shows the circuit structure of the clocked inverter driven by the signal pulse $\phi$1 as described above. Since the clocked inverter is driven by p-channel poly-Si TFTs 42, 43 and n-channel poly-Si TFTs 44, 45 and a complementary signal pulse, the clocked inverter has three kinds of output states, namely, high and low states of a CMOS inverter and an output disconnection state (or floating state).

Table 1 shows values of the channel width W and the channel length L of the CMOS inverter 36 in the single unit of the latch circuit shown in FIG. 3. Therein, by making the values of W/L of the p-channel poly-Si TFTs and the n-channel poly-Si TFTs composing the CMOS inverter 36 extremely unbalanced, the value of the input threshold necessary for inverting the output of the CMOS inverter 36 can be set to a very small value. More specifically, the CMOS inverter 36 is driven by 5 V/0 V, but the input threshold is designed so as to be driven by 1 V, not 2.5 V.

TABLE 1

| | W/L |
|---|---|
| pMOS | 4/20 |
| nMOS | 20/4 |

The construction of the DA converter 6 will be described below with reference to FIG. 5.

Figure 5:
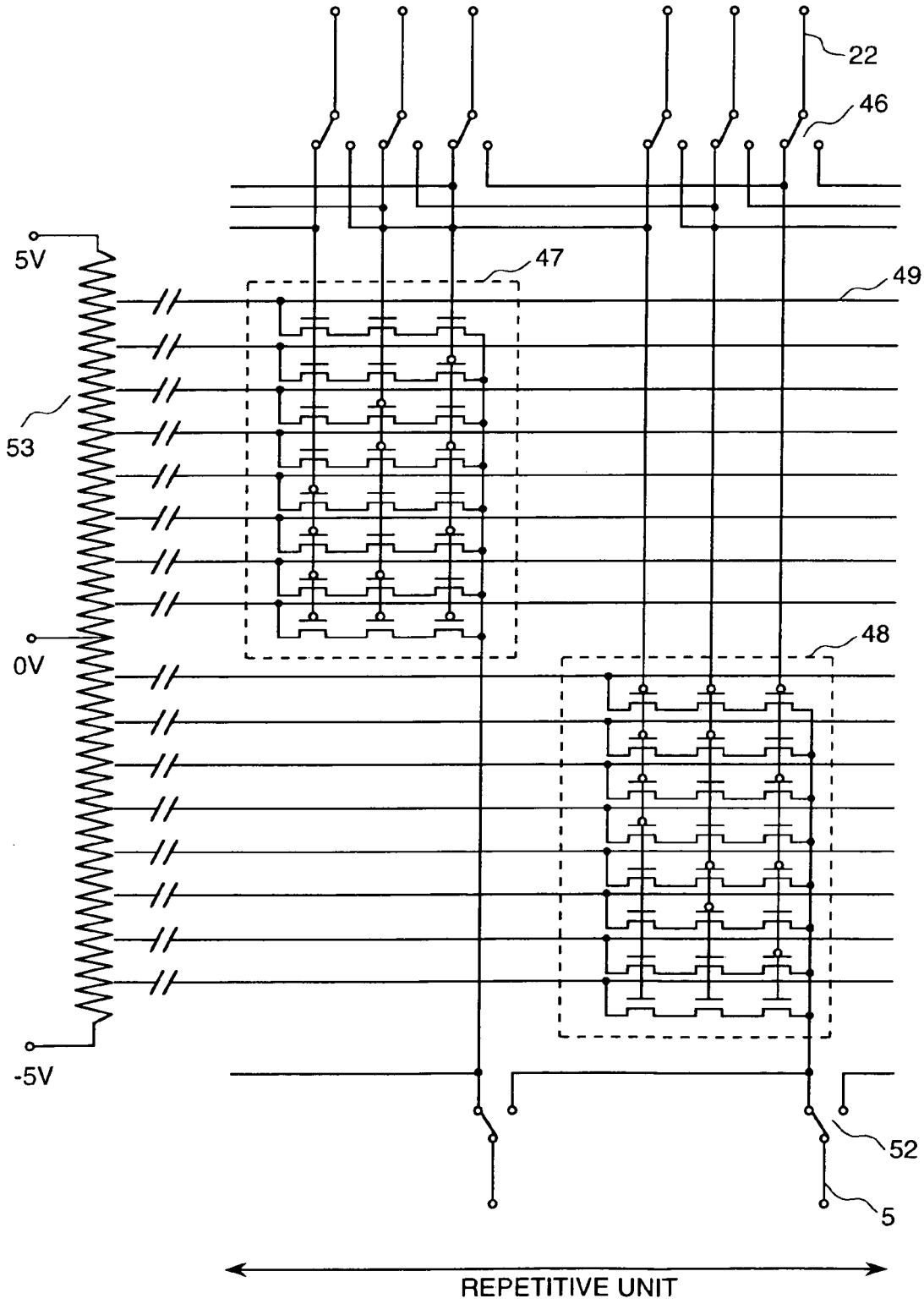
FIG. 5 is a circuit diagram showing the construction of a single unit of DA converter in the first embodiment.

FIG. 5 is a diagram showing the construction of a single unit (a repetitive unit) of the DA converter 6 which corresponds to 6 lines of the data line 22B. In the present embodiment, since 3-bit image data is expressed by one set of 3 lines of the data line 22B, the DA converter for two sets of image data is included in the one single unit of the DA converter. Each of the data lines 22B is selectively connected to a positive voltage selection circuit 47 or a negative voltage selection circuit 48 through an inverse input switch 46, and the outputs of the positive voltage selection circuit 47 and the negative voltage selection circuit 48 are connected to the signal line 5 through an inverse output switch 52. Therein, analogue gray scale voltages generated in a gray scale voltage generating resistor 53 are input to the positive voltage selection circuit 47 and the negative voltage selection circuit 48 through gray scale power source lines 49; and, accordingly, the positive voltage selection circuit 47 and the negative voltage selection circuit 48 have the function to output analogue voltage values corresponding to the 3-bit image data. The gray scale voltage generating resistor 53 is formed particularly using a low-resistance poly-Si thin film doped with boron (B). This is a structure similar to the source and the drain thin films of the p-channel poly-Si TFT used in the present embodiment. If the gate wire or a general metallic wire is used for the gray scale voltage generating resistor 53, the electric power consumption and the area of the gray scale voltage generating resistor 53 are substantially increased because the resistance of the gate wire and the general metallic wire is too small. On the other hand, since phosphorus (P) is apt to segregate in grain boundaries of poly-Si during a thermal process, such as an activation process, the resistance is apt to be changed due to variation of the crystals; and, accordingly, misalignment of color is apt to occur due to deviation of the values of gray scale power source voltage from the design values. However, since boron (B) does not allow such segregation to occur, the resistance values are stable, and, in addition, the sheet resistance value is an appropriate value of several kΩ/□. Therefore, the poly-Si thin film doped with boron (B) is most suitable for the gray scale voltage generating resistor 53, because the electric power consumption is small, and the area is not large, and the values of generated gray scale power source voltage are stable. Table 2 shows measured values of dispersion in sheet resistance of a boron (B) doped poly-Si thin film and a phosphorus (P) thin film. Since the dispersion in sheet resistance of the phosphorus (P) thin film is above 4 times as large as that of the boron (B) doped poly-Si thin film, it is preferable to use the boron (B) doped poly-Si thin film for the gray scale voltage generating resistor 53.

TABLE 2

| | sheet resistance: σ (%) |
|---|---|
| B doped poly-Si film | 3.7 |
| P doped poly-Si film | 20.5 |

Figure 6:
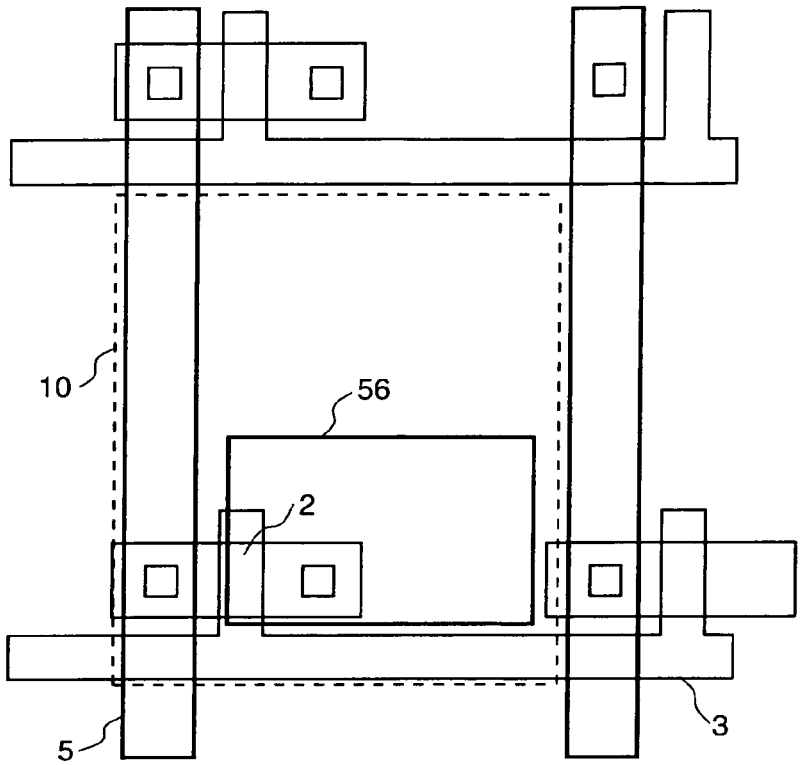
FIG. 6 is a diagram showing the layout of a pixel in the first embodiment.

The construction of the pixel 10 will be described with reference to FIG. 6, which is a diagram showing the layout of the pixel 10, in which only the wires and the TFT portions are illustrated in order to simplify the explanation. Particularly, the low-resistance wire using Al is illustrated by a bold line, and the contact hole is illustrated by a square. The signal line 5 is connected to the drain of the n-channel poly-Si TFT composing the pixel switch 2 with a contact hole, and the gate of the pixel switch 2 is formed together with the gate line 3 in a one-piece structure. The source of the pixel switch 2 is connected to an ITO (not shown) through a pixel electrode 56. The pixel electrode 56 is made of Al having a high reflectivity; and, the present polycrystalline Si-TFT liquid crystal display panel can be used as a transmission type panel when the back light is turned on, and it also can be used as a reflection type panel when the back light is not turned on. Particularly, the display of the reflection type is characterized by low electric power consumption; and, needless to say, such low electric power consumption is the main object of the present invention and is a very important consideration.

The construction of the memory cell 11 will be described below, while comparing it to the construction of the pixel 10.

Figure 7:
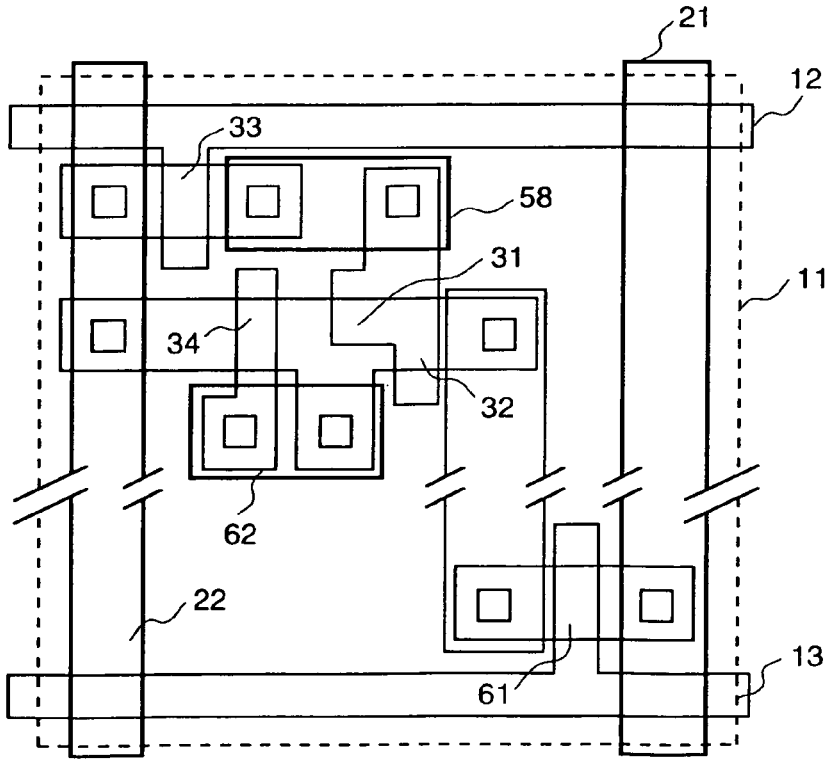
FIG. 7 is a diagram showing the layout memory cell in the first embodiment.

FIG. 7 is a diagram showing the layout of the memory cell 11, and it illustrates only one basic unit of the memory cell for the sake of simplification. The low-resistance wire using Al is illustrated by a bold line, and the contact hole is illustrated by a square, similarly to FIG. 6. The data line 22 is connected to one end of a memory switch 33 in which the gate thereof is formed by the word line 12. The other end of the memory switch 33 is connected to the gate of a memory amplifier 32 through an Al wire, and at the same time the Al wire forms a memory capacitor 31. The source of the memory amplifier 32 is connected to the data line 22 through an output switch 34 of a diode-connected n-channel poly-Si TFT. Further, the drain of the memory amplifier 32 is connected to the common drain line 21 through a read-out switch 61 controlled by a read-out line 13 at one end of the memory cell 11. In order to prevent a large current from transiently flowing in the common drain line 21, as to be described later, the common drain line 21 is not arranged in parallel to the word line 12, but arranged in parallel to the data line 22.

Figure 8:
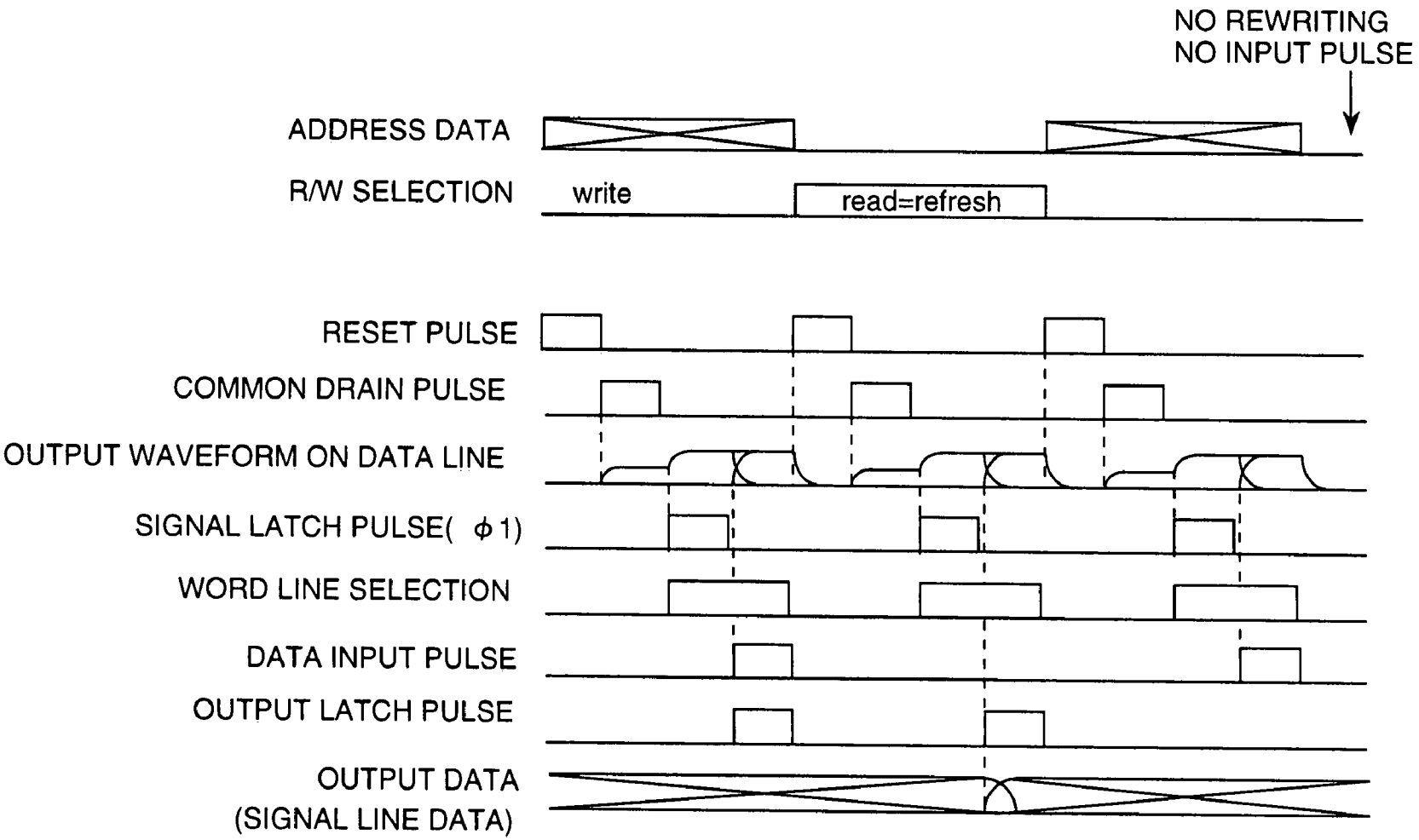
FIG. 8 is a timing chart showing the operation timings in the first embodiment.

The operation of the present embodiment will be described with reference to FIG. 8, which is a chart showing operation timings of various portions in the present invention. In FIG. 8, the time axis on the left hand side expresses the operations of "writing to the memory", "reading out from the memory", "writing to the memory" and "pause". Further, items not particularly mentioned correspond to a waveform having an amplitude of 5V.

Initially, the operation of "writing to the memory" will be described. The R/W selection pulse switches the address selection switch 17 to the memory y-address decoder 18, and the memory y-address decoder 18 is connected to the read-out line buffer 15 through the buffer selection switch 16 to turn on the read switch 61, on the selected address row. The reset pulse turns on the data line reset circuit 23 to reset the data line 22, to 0 V. Next, the voltage on the common drain line 21 rises up to apply the high level voltage (for example, 5V) to the drain of the memory amplifier 32 of the memory cell on the above-mentioned address row. However, if the memory capacitor 31 has been written at the high level voltage at that time, the memory amplifier 32 is turned on to propagate the high level voltage to the data line 22. Therein, the memory capacitor also serves as a bootstrap capacitor having a function to boost the gate voltage of the memory amplifier 32. On the other hand, if the memory capacitor 31 has been written at the low level voltage (for example, 0 V), the memory amplifier 32 is kept in the OFF-state, and, accordingly, the high level voltage of the common drain line 21 is not output to the data line 22. Therein, if the voltage of the common drain line 21 is returned to the low level after that, the voltage written in the data line is held as it is. Next, when the signal latch pulse ϕ1 is input, the latch circuit shown in FIG. 3, provided for each of the data lines 22, is put into operation to determine the voltage of the data line to the high level voltage or the low level voltage by operation of the clocked inverter 37. Therein, the reason why the threshold of the inverter 36 is lowered is to cover the voltage output from the memory amplifier 32 to the data line 22 when the voltage is insufficient. Therein, similarly to the signal latch pulse ϕ1, the buffer selection switch 16 is switched to the word line buffer 14 to set the word line 12 on the given row to the high voltage level. Thereby, the image data written in the data line 22 is rewritten in the same memory capacitor 31. After that, when a data input pulse is input, the memory x-address decoder 26 turns on the data line input switch of the selected address, and, as a result, the data on the data line 22 on the selected row is rewritten to a new written data which is input through the data input line 25. By the above-mentioned operation, the data of the memory cell of which the address (x, y) is selected is rewritten to the new data, and the data of the other memory cells having the same y-address is not changed.

Next, the operation of "reading out from the memory" will be described below. The R/W selection pulse switches the address selection switch 17 to the memory shift register 19, and the memory shift register 19 is connected to the read-out line buffer 15 through the buffer selection switch 16 to turn on the read switch 61 on the selected address row. Then, the reset pulse turns on the data line reset circuit 23 to reset the data line 22 to 0 V, and the common drain line 21 rises up to output the data of the memory cell to the data line 22, and the voltage of the data line is determined to be the high level voltage or the low level voltage by the signal latch pulse ϕ1, which is the same processes as described in the operation of "writing to the memory" above. Therein, when the buffer selection switch 16 is switched to the word line buffer 14 to set the word line 12 on the given row to the high voltage level, the image data written in the data line 22 is rewritten in the same memory capacitor 31. This corresponds to the refresh operation to the memory cell (i.e., a rewrite operation is performed to refresh), to be described later. When the output latch pulse ϕ2 is output, the image data is output to the data line 22B through the clocked inverter 38. By the above-mentioned operation, the data of the memory cells on the row selected by the memory shift register 19 is refreshed, and, at the same time, the data is output to the data line 22B.

In the operation of "reading out from the memory", the operation of the gate line shift register 4 sequentially selecting the gate lines 3 is identical with the operation of the memory shift register 19, sequentially selecting the read-out lines 13 and the word lines 12. Therefore, the image data output to the data line 22B is written in the liquid crystal capacitor 1 through the DA converter 6 and the pixel switch 2 on the selected row during the horizontal scanning period after that. Further, the selection of a row of the memory cells by the memory shift register 19 is performed periodically every 1/60 second of 1 field period. Therefore, the operation of "reading out from the memory" of the memory cell can be used as the refresh operation.

The operation of the DA converter 6, the construction of which has been described with reference to FIG. 5, will be described below in detail. The inverse input switch 46 and the inverse output switch 52 are switched pairing with each other every field period, and the circuit used for the same row of the memory cell or the same row of the pixel is alternatively exchanged between the positive voltage selection circuit 47 and the negative voltage selection circuit 48. This is because it is necessary to switch the positive and negative voltage output to the signal line 5 in order to perform alternating current drive of the liquid crystal capacitor. However, the area occupied by the DA converter can be made smaller by alternatively using the voltage selection circuits 47, 48.

Finally, the operation of "pause" will be described. In a case where it is not a time of reading to the memory cell and written data is not being transmitted, all the clocks are stopped, as shown in FIG. 8. At that time, the consumption of electric power around the memory during this period can be made essentially zero, because there is no circuit under operation.

In the operations described above, during the writing of the high level voltage to the memory capacitor 31 through the memory switch 33 or during the applying of the high level voltage to the drain of the memory amplifier 32 through the read-out switch 61, the high level voltage can be written or applied only up to the memory switch 33 or the position ((gate electrode applied voltage)−(the threshold voltage Vth of the TFT)) of the read-out switch 61. Therefore, in the present embodiment, the phenomenon is avoided by setting the driving voltage of the word line 12 and the read-out line 13 higher than that for the other circuits. More specifically, the driving voltage of the word line 12 and the read-out line 13 is set to 10 V, while the other pulses are 5-Volt driven. Even if such a high driving voltage is used, an increase in the electric power consumption to the total electric power is very small because the capacity of the word lines 12 and the read-out lines 13 is not so large.

In the case where the DRAM structure is employed for the memory cell, as described above, there arises a problem of leakage current from the memory capacitor 31 to the memory switch 33 due to light irradiation. Particularly, in the case where the operation of refreshing is in synchronism with the operation of writing to the pixel, as in the present invention, the required capacity of the memory capacitor 31 sometimes becomes abnormally large. Therefore, it is preferable that a black matrix shielding film is formed on the reverse surface of the glass substrate 8, particularly, on the portion of the memory cell array. Otherwise, a similar effect can be obtained by designing the optical system of the reverse surface so that light of the back light may not reach the memory cell array. Light shielding in the upper portion of the memory cell array can be similarly considered.

In the present embodiment, each of the circuit blocks is constructed on a glass substrate using polycrystalline Si-TFT elements. However, it is obvious that a quartz substrate or a transparent plastic substrate may be used instead of the glass substrate, and that an opaque substrate, such as an Si substrate, etc., may be used by limiting the liquid crystal display method to the reflecting type.

Further, of course, it is possible that the n-type and the p-type of the TFTs in the various kinds of circuits described above and the voltage relations may be inversely constructed, or that other circuit structures may be employed without deviating from the principle of the present invention.

Although it has been assumed in the above description that the image display data is of 3 bits and the gray scale voltage lines 49 are 8 parallel wires supplied with different gray scale voltages, it is obvious that the gray scale voltage lines are $2^n$ parallel wires supplied with different gray scale voltages, when the image display data is n-bit.

In addition, although in the present embodiment CMOs switches are used for the various kinds of switches and n-type TFT switches are used for the pixel TFTS, the present invention can be applied when any kinds of switch structures, including p-type TFTs, are used. Further, it is needless to say that various kinds of layout configurations can be applied without departing from the scope of the present invention.

Embodiment 2

A second embodiment in accordance with the present invention will be described below with reference to FIG. 9.

Figure 9:
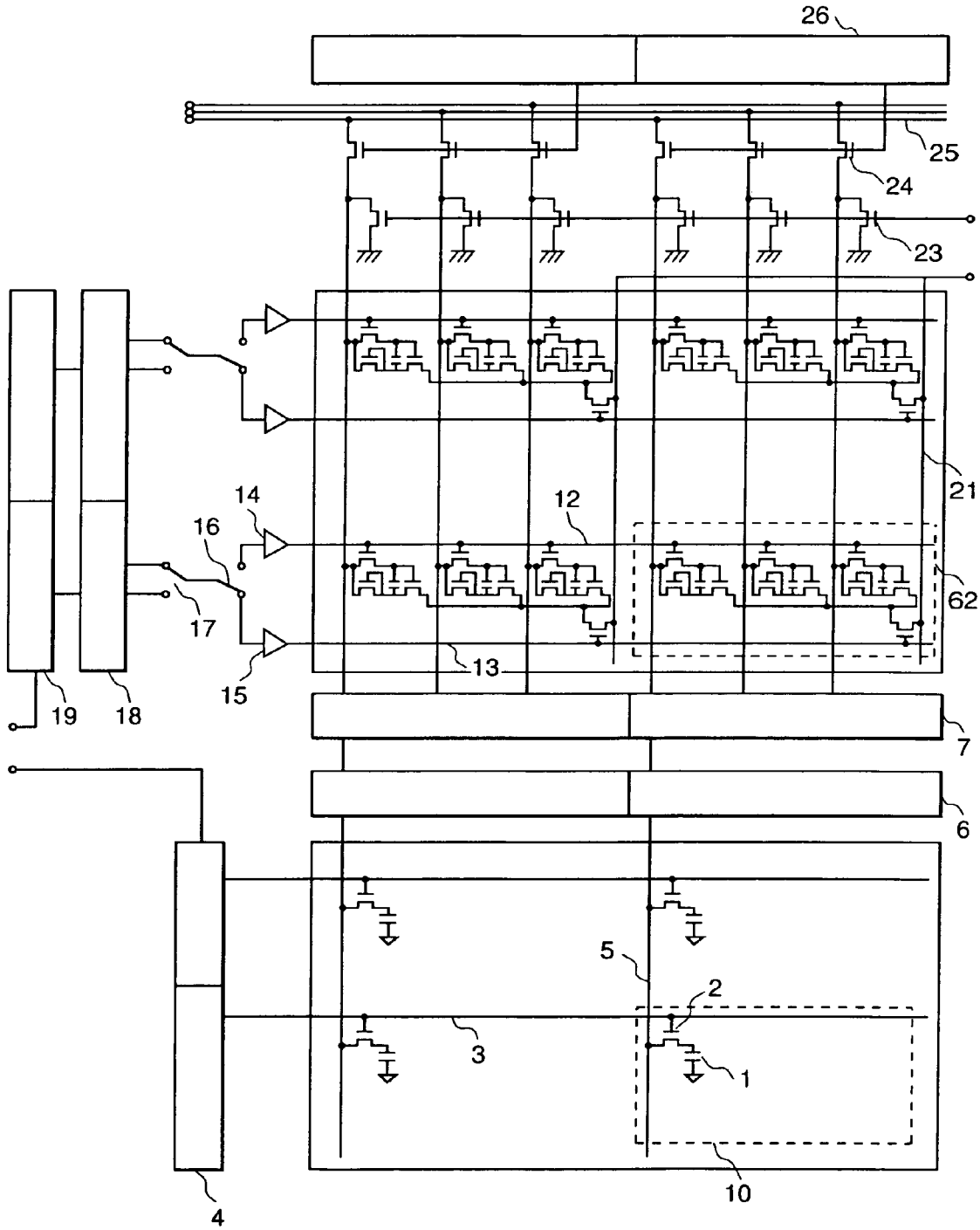
FIG. 9 is a schematic diagram showing the construction of a second embodiment of a liquid crystal display panel.

Since the main structure and the main operation of the second embodiment of a polycrystalline Si-TFT liquid crystal display panel shown in FIG. 9 are similar to those of the first embodiment, the description thereof is omitted here. The main differences between the present embodiment and the first embodiment are that the structure of the memory cell 62 is different, and the drive wires of the memory shift register 19 and the gate line shift register 4 are separated. Description will be made below concerning these points.

The present embodiment is characterized by the fact that, in the layout of the memory cells, the 3-bit unit cells composing image data are horizontally aligned in a row, and the memory capacitor is provided as a real capacitor, and not a TFT gate capacitor. The present embodiment can substantially shorten the memory width in the y-direction by the memory cell arrangement described above, and it can be operated with strong stability against noise because the memory capacitor can obtain a sufficient capacitance value even if the voltage of writing to the memory cell is a low level voltage. Therein, by using an ITO film in the pixel, it is possible to further provide a memory capacitor using the grounded ITO film in order to further increase the memory capacity. By additionally providing a wire to which a DC voltage is applied, a capacitor independent of the above-mentioned capacitor can be also provided using the wire, though there is a problem in that the structure becomes complicated.

Since the drive wires of the memory shift register 19 and the gate line shift register 4 are separately provided, the writing operation to the pixel array can be performed, for example, at a speed one-half of a speed of the refreshing, while the refreshing operation of the memory cell is being performed in a necessary timing. By doing so, the present embodiment can further reduce the electric power consumption.

Embodiment 3

A third embodiment in accordance with the present invention will be described below with reference to FIG. 10.

Since the main structure and the main operation of the third embodiment of a polycrystalline Si-TFT liquid crystal display panel are similar to those of the first embodiment, the description thereof is omitted here. The main difference between the present embodiment and the first embodiment is the circuit structure of the basic unit of the memory cell 62. Description will be made below concerning this point.

Figure 10:
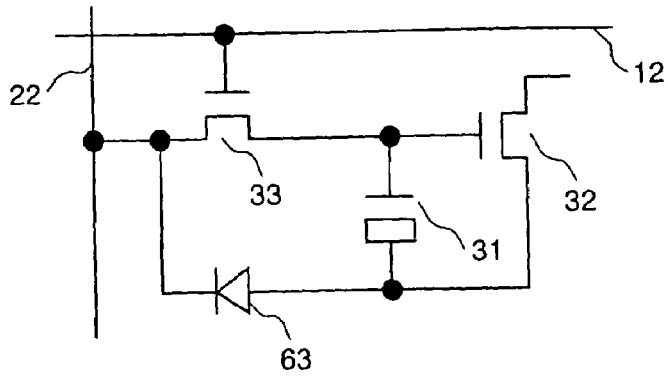
FIG. 10 is a circuit diagram showing the circuit of a basic unit of a memory cell in a third embodiment.

FIG. 10 is a diagram showing the circuit structure of the basic unit of the memory cell in the third embodiment, which corresponds to FIG. 2 in the first embodiment. The difference between the present embodiment and the first embodiment is that the output switch 34 is changed to a p-n junction diode 63 formed on the poly-Si thin film from the diode-connected n-channel poly—Si TFT. The p-n junction diode 63 is formed by providing an impurity zone of approximately 2 μm length between a p-type impurity zone and an n-type impurity zone. Since the present embodiment simplifies the structure of the basic unit of the memory cell by using the p-n junction diode 63, both a reduction of the memory area and an improvement in the production yield can be attained.

Embodiment 4

Figure 11:
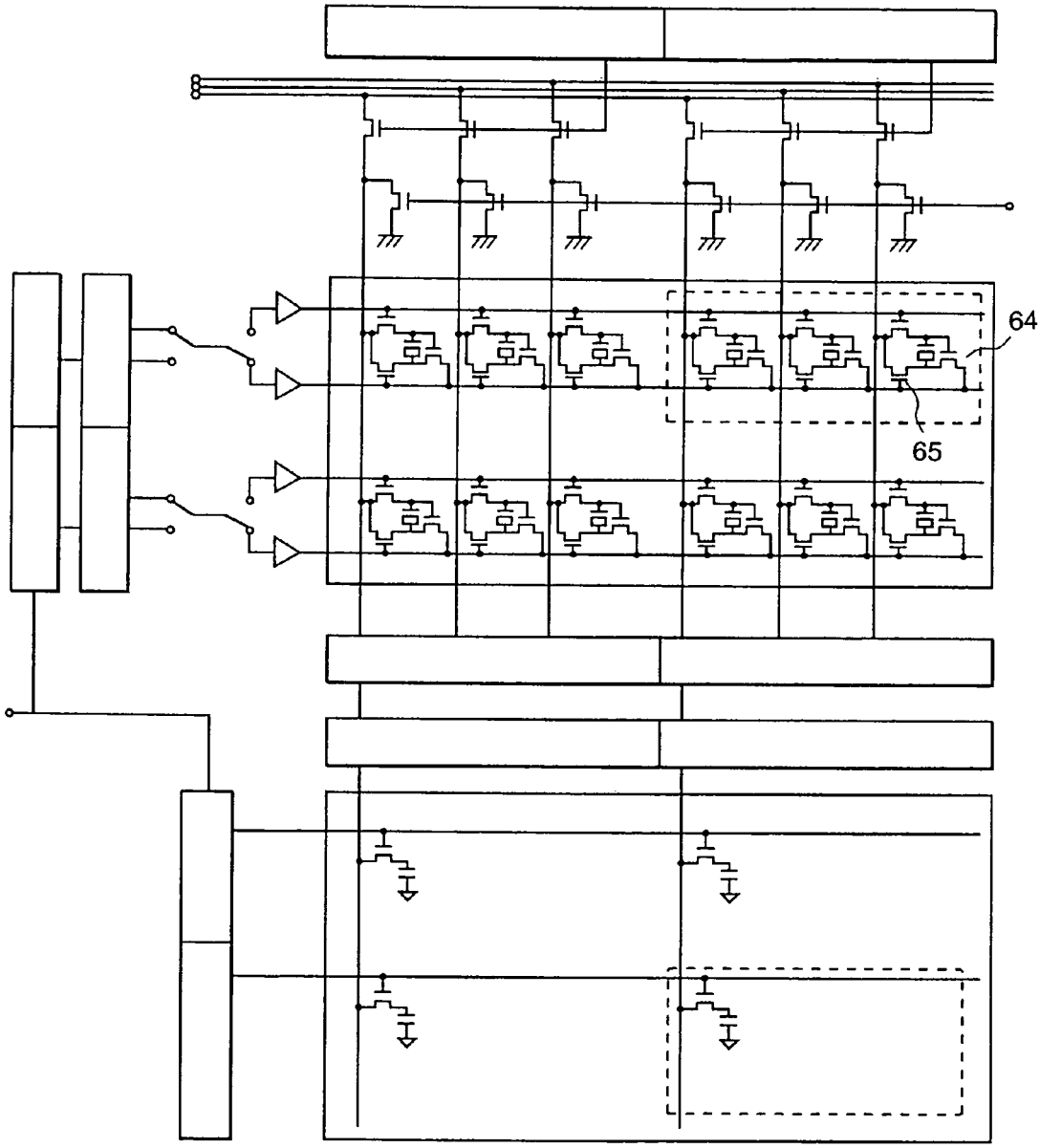
FIG. 11 is a schematic diagram showing the construction of a fourth embodiment of a liquid crystal display panel.

A fourth embodiment in accordance with the present invention will be described with reference to FIG. 11, which is a diagram showing the construction of the fourth embodiment of the polycrystalline Si-TFT liquid crystal display panel.

Since the main structure and the main operation of the present embodiment are similar to those of the first embodiment, the description thereof is omitted here. The main difference between the present embodiment and the first embodiment is the circuit structure of the memory cell. Description will be made below concerning this point.

In the present embodiment, the common drain line 21 and the read-out switch 61 are eliminated; and, at the same time, the memory amplifier 64 is directly driven by the read-out line 13, the output switch 65 is formed by a general n-channel poly-Si TFT and the gate is connected to the read-out line 13. According to the present embodiment, the structure of the memory cell can be simplified, and both a reduction of the memory area and an improvement in the production yield can be attained. However, in the present embodiment, the read-out current to all the data lines 22 through the memory amplifier 64 needs to be supplied from one read-out line 13 in all cases. Therefore, it is necessary to reduce the resistance of the output of the read-out line buffer 15 and to reduce the resistance of the read-out line 13.

Embodiment 5

A fifth embodiment in accordance with the present invention will be described with reference to FIG. 12 and FIG. 13.

Figure 12:
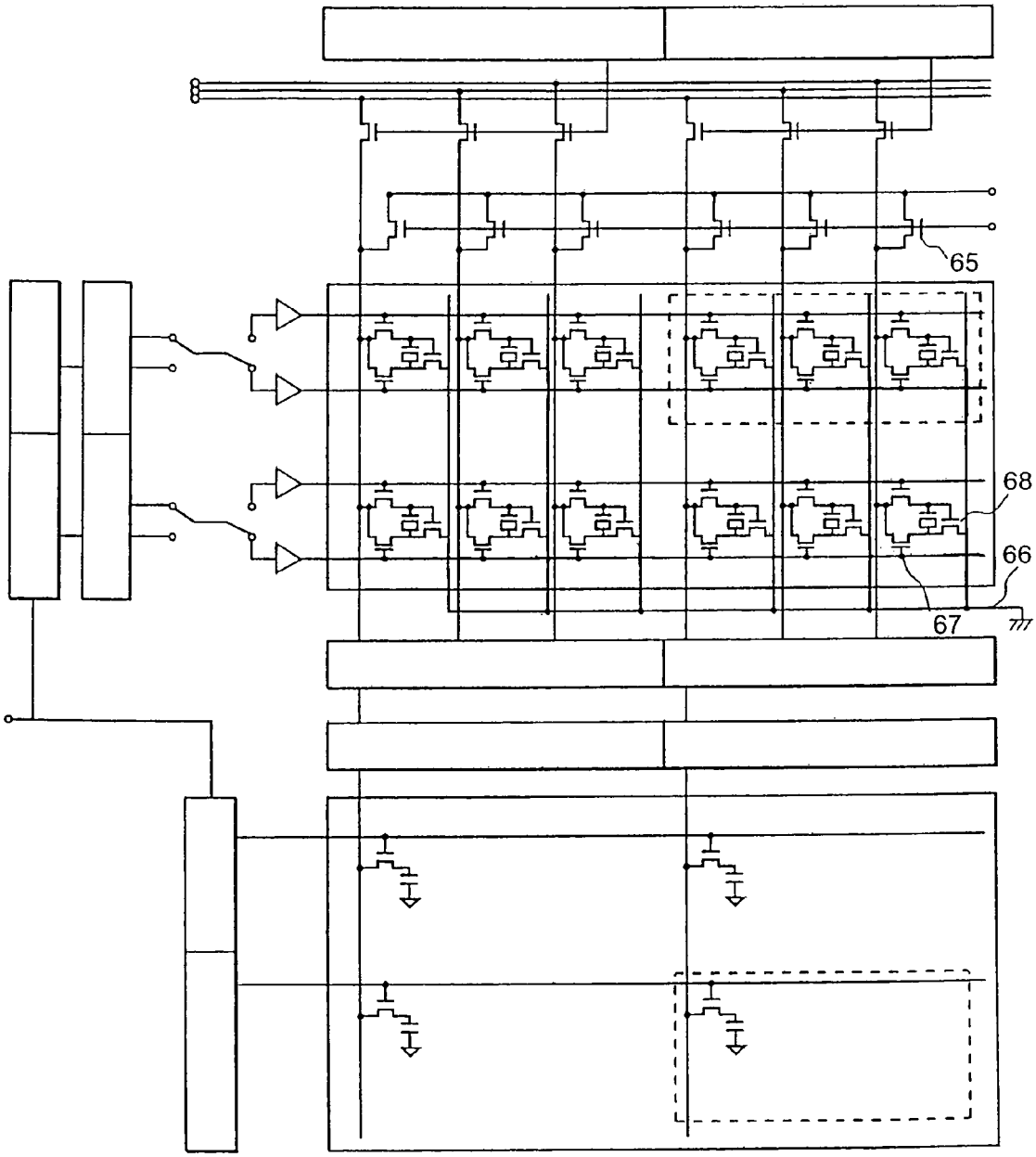
FIG. 12 is a schematic diagram showing the construction of a fifth embodiment of a liquid crystal display panel.

FIG. 12 is a diagram showing the construction of the fifth embodiment of the polycrystalline Si-TFT liquid crystal display panel. Since the main structure and the main operation of the present embodiment are similar to those of the first embodiment, the description thereof is omitted here. The main differences between the present embodiment and the first embodiment are that the reset voltage of the data line reset circuit 65 is not 0 V, but is a high level voltage, one end of the memory amplifier 68 is grounded to 0 V through the common drain line 66, the output switch 69 is constructed by a general n-channel poly-Si TFT and the gate is connected to the read-out line 13, and the basic structure of the latch circuit 67 is changed, as will be described later with reference to FIG. 13.

In the present embodiment, since the voltage applied to the memory amplifier 68 is inverted, the output of the memory amplifier 68, is driven as the drain side. As a result, it is possible to solve the problem existing in the first embodiment that the TFT can be operated only up to the position ((gate electrode applied voltage)−(the threshold voltage Vth of the TFT)) at the time of a read-out operation. As a result, the memory cell circuit can be stably operated without setting the drive voltage of the word line 12 and the read-out line 13 higher than that of the other circuits. However, in the present embodiment, the output voltage to the data line 22 is a low level voltage when the write voltage to the memory capacitor 31 is the high level voltage, and the output voltage to the data line 22 becomes a high level voltage when the write voltage to the memory capacitor 31 is a low level voltage. That is, the write voltage level is inverted at every refresh operation if it is left as it is. Therefore, in the present embodiment, the latch circuit 67 is modified as described below.

Figure 13:
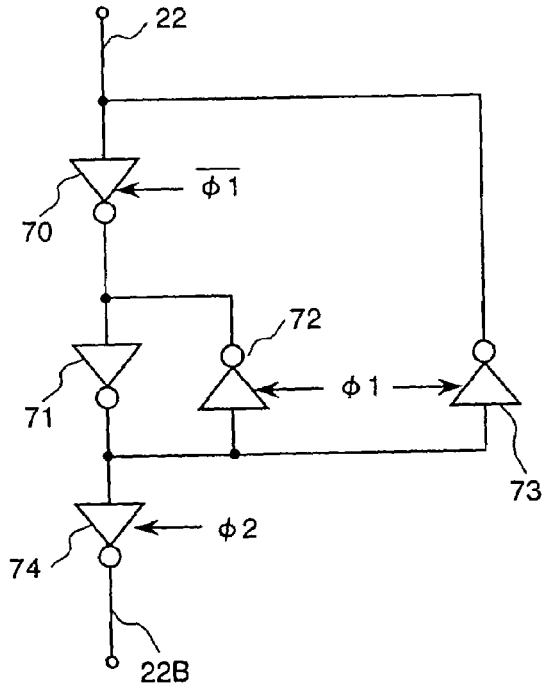
FIG. 13 is a circuit diagram showing the construction of a single unit of a latch circuit in the fifth embodiment.

FIG. 13 is a diagram showing the structure of the single unit of the latch circuit, which corresponds to FIG. 3 in the first embodiment. The data line 22 is input to a clocked inverter 70 driven by inverting the signal pulse ϕ1, and the output of the clocked inverter 70 is input to a CMOS inverter 71. The output of the CMOS inverter 71 is connected to clocked inverters 72, 73 driven by the signal pulse ϕ1 and a clocked inverter 74 driven by a signal pulse ϕ2. Further, the output of the clocked inverter 72 is fed back to the input of the CMOS inverter 71, the output of the clocked inverter 73 is fed back to the data line 22, and the clocked inverter 74 is output to the data line 22B. In the present embodiment, by employing the construction described above, the voltage level of the data line 22 is inverted at the time when the latch pulse ϕ1 is input. By employing the latch circuit, the present embodiment can set the drive voltage of the word line 12 and the read-out line 1.3 to a value equal to the drive voltage for the other circuits, for example, to 5 V, while the write voltage level is prevented from being inverted for every refresh operation.

Embodiment 6

Figure 15:
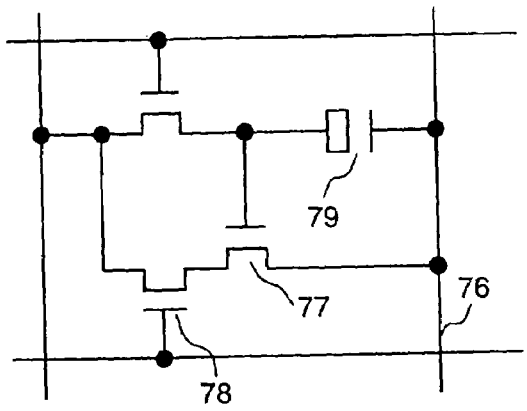
FIG. 15 is a circuit diagram showing the circuit of a basic unit of a memory cell in the sixth embodiment.
Figure 14:
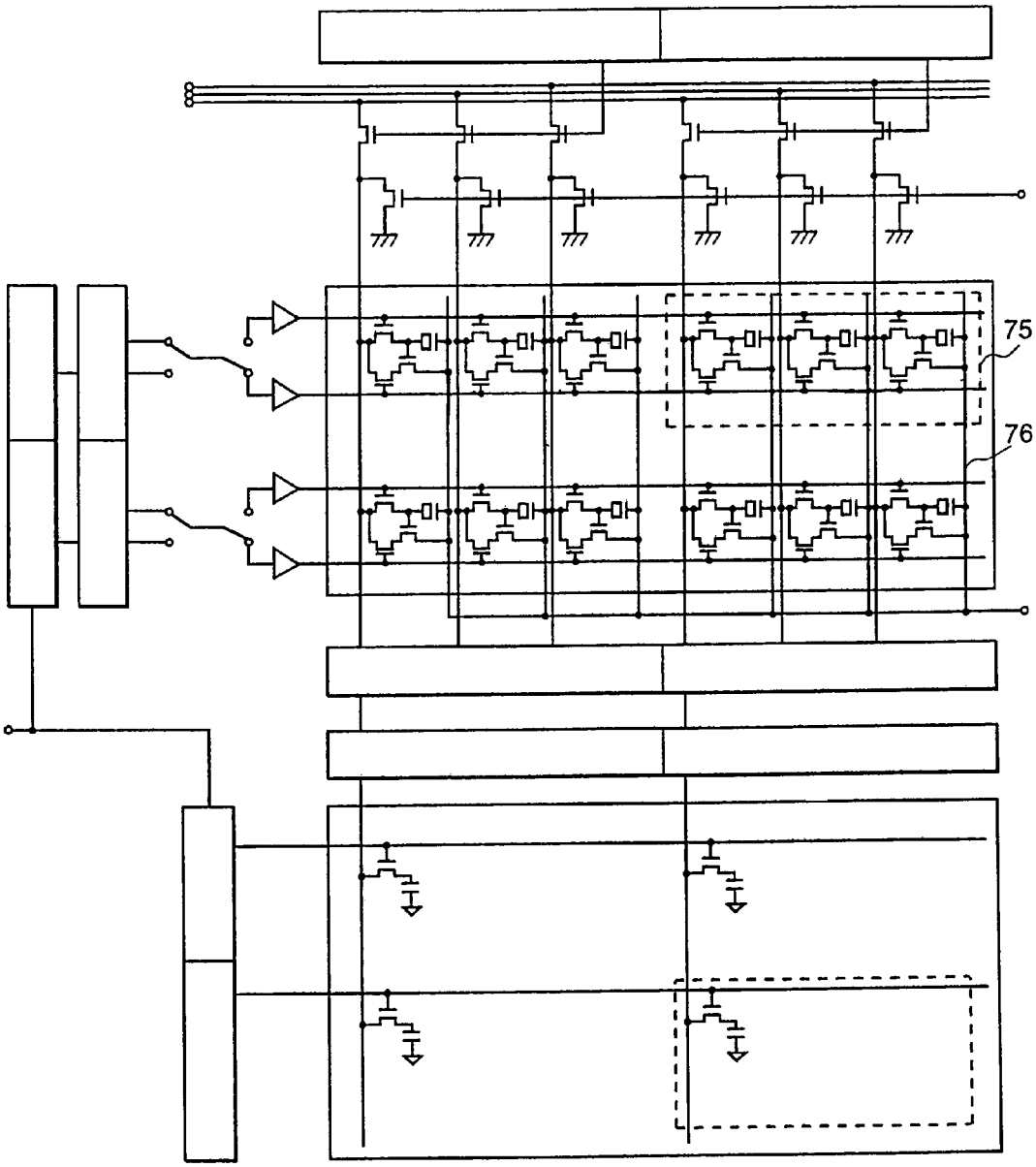
FIG. 14 is a schematic diagram showing the construction of a sixth embodiment of a liquid crystal display panel.

A sixth embodiment in accordance with the present invention will be described with reference to FIG. 14 and FIG. 15. FIG. 14 is a diagram showing the construction of the sixth embodiment of the polycrystalline Si-TFT liquid crystal display panel, and FIG. 15 is a diagram showing the circuit of the basic unit of the memory cell 75.

Since the main structure and the main operation of the present embodiment are similar to those of the first embodiment, the description thereof is omitted here. The main differences between the present embodiment and the first embodiment are that one end of the memory amplifier 77 is fixed to a DC high level voltage through the common drain line 76, and output switch 78 is constructed as a general poly-Si TFT, the gate is connected to the read-out line 13, and further that the gate of the n-channel poly-Si TFT composing the memory capacitor 79 is connected to the common drain line 76.

The operation of the present embodiment is different from the operation of the first embodiment in that the memory amplifier 77 is simultaneously put into operation when the output switch 78 is selected and turned on because the drain side of the memory amplifier 77 is fixed to the high level voltage. However, the operation of the present embodiment is essentially similar to the operation of the first embodiment.

The present embodiment has an advantage in that the structure of the memory cell 75 is simplified compared with that of the first embodiment, because the DC voltage is applied to the one end of the memory amplifier 77 through the common drain line 76. Further, the present embodiment has an advantage in that the capacity of the memory capacitor becomes large so as to stabilize the operation, particularly when writing to the memory cell is at the low level, because the construction of the memory capacitor 79 is a n-channel poly-Si TFT of which the gate is connected to the common drain line 76.

Embodiment 7

A seventh embodiment in accordance with the present invention will be described with reference to FIG. 16 and FIG. 17.

Figure 16:
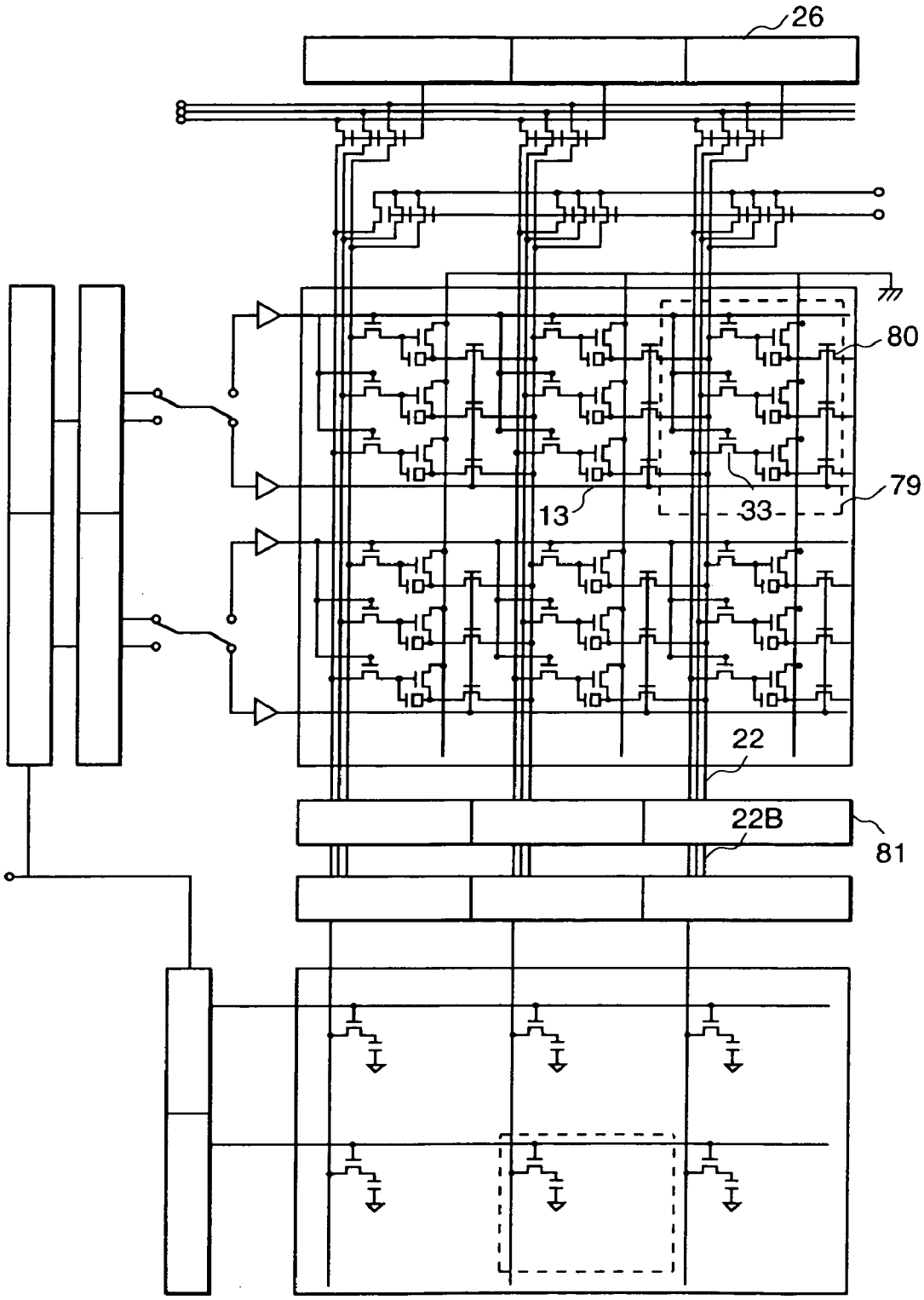
FIG. 16 is a schematic diagram showing the construction of a seventh embodiment of a liquid crystal display panel.

FIG. 16 is a diagram showing the construction of the seventh embodiment of the polycrystalline Si-TFT liquid crystal display panel. Since the main structure and the main operation of the present embodiment are similar to those of the fifth embodiment, the description thereof is omitted here. The main difference between the present embodiment and the fifth embodiment are that the data line 22, to which one end of the memory switch 80 is connected, is different from the data line 22 to which the memory switch 33 is connected, and the basic structure of the latch circuit 81 is changed, as will be described later with reference to FIG. 17.

The difference in operation of the present embodiment from that of the fifth embodiment is that the data line 22 for inputting the image data to the memory cell 79 is different from the data line 22 for outputting the image data from the memory cell 79. Therefore, the structure of the latch circuit used is modified as shown in FIG. 17.

Figure 17:
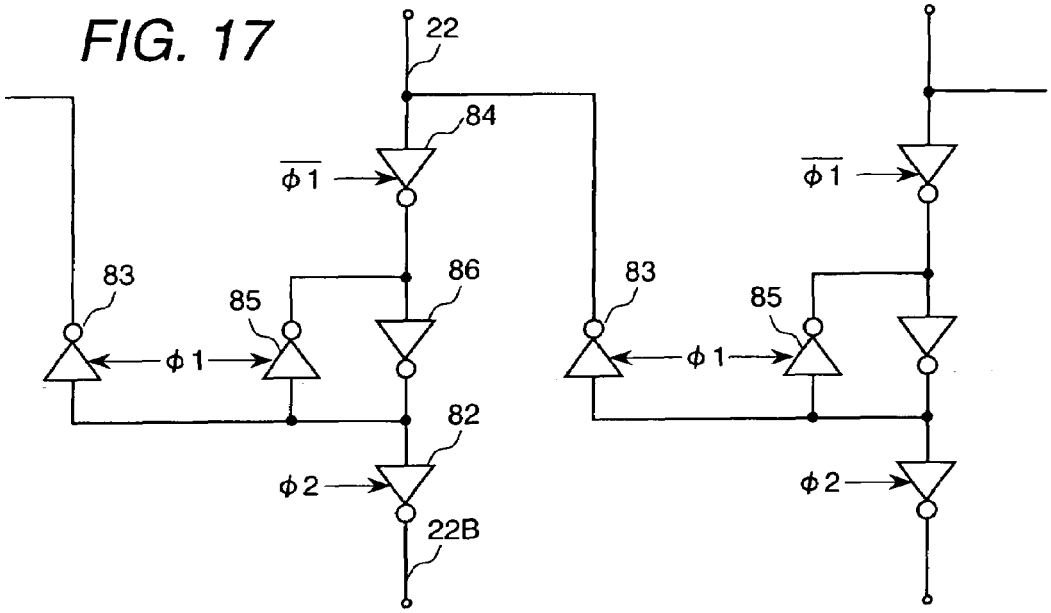
FIG. 17 is a circuit diagram showing the construction of a single unit of a latch circuit in the seventh embodiment.

FIG. 17 is a diagram showing the construction of one unit of the latch circuit in the present embodiment, and it corresponds to FIG. 13 in the fifth embodiment. The data line 22 is input to a clocked inverter 84 driven by inversion of the signal pulse ϕ1, and the output of the clocked inverter 84 is input to a CMOS inverter 86. The output of the CMOS inverter 86 is connected to clocked inverters 83, 85 driven by the signal pulse ϕ1 and to a clocked inverter 82 driven by the signal pulse ϕ2. The output of the clocked inverter 85 is fed back to the input of the CMOS inverter 86, the output of the clocked inverter 83 is fed back to another corresponding data line 22, and the clocked inverter 82 outputs to the data line 22B. In the present embodiment, by employing the structure described above, the voltage level of the data line 22 is simultaneously inverted when the latch pulse ϕ1 is input, and it is written in the other corresponding data line 22. As described above, by employing the latch circuit 81 described above, the present embodiment can return the image data read out to the other data line 22 to the original data line 22, and, at the same time, it can set the drive voltage of the word line 12 and the read-out line 13 to a value equal to the drive voltage for the other circuits, for example, to 5 V, while the write voltage level is prevented from being inverted at every refresh operation.

Embodiment 8

Figure 18:
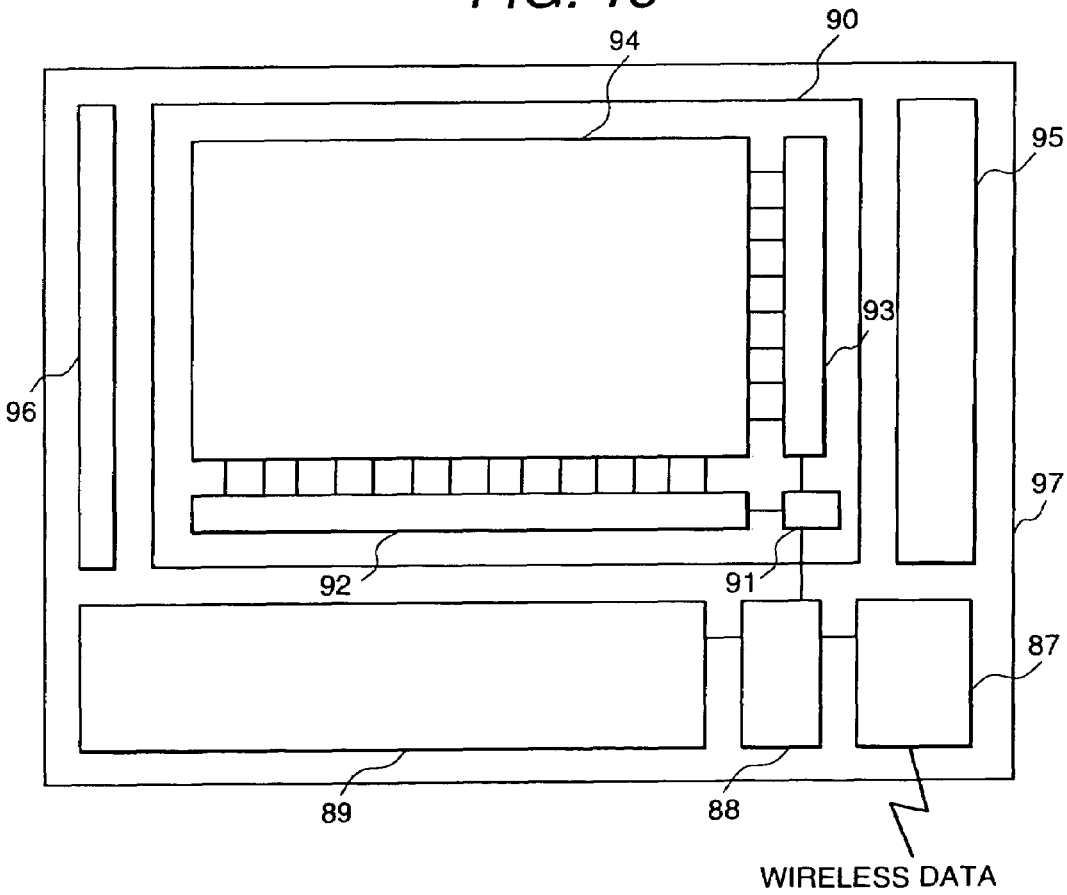
FIG. 18 is a block diagram showing the construction of an eighth embodiment of an image browser.
Figure 19:
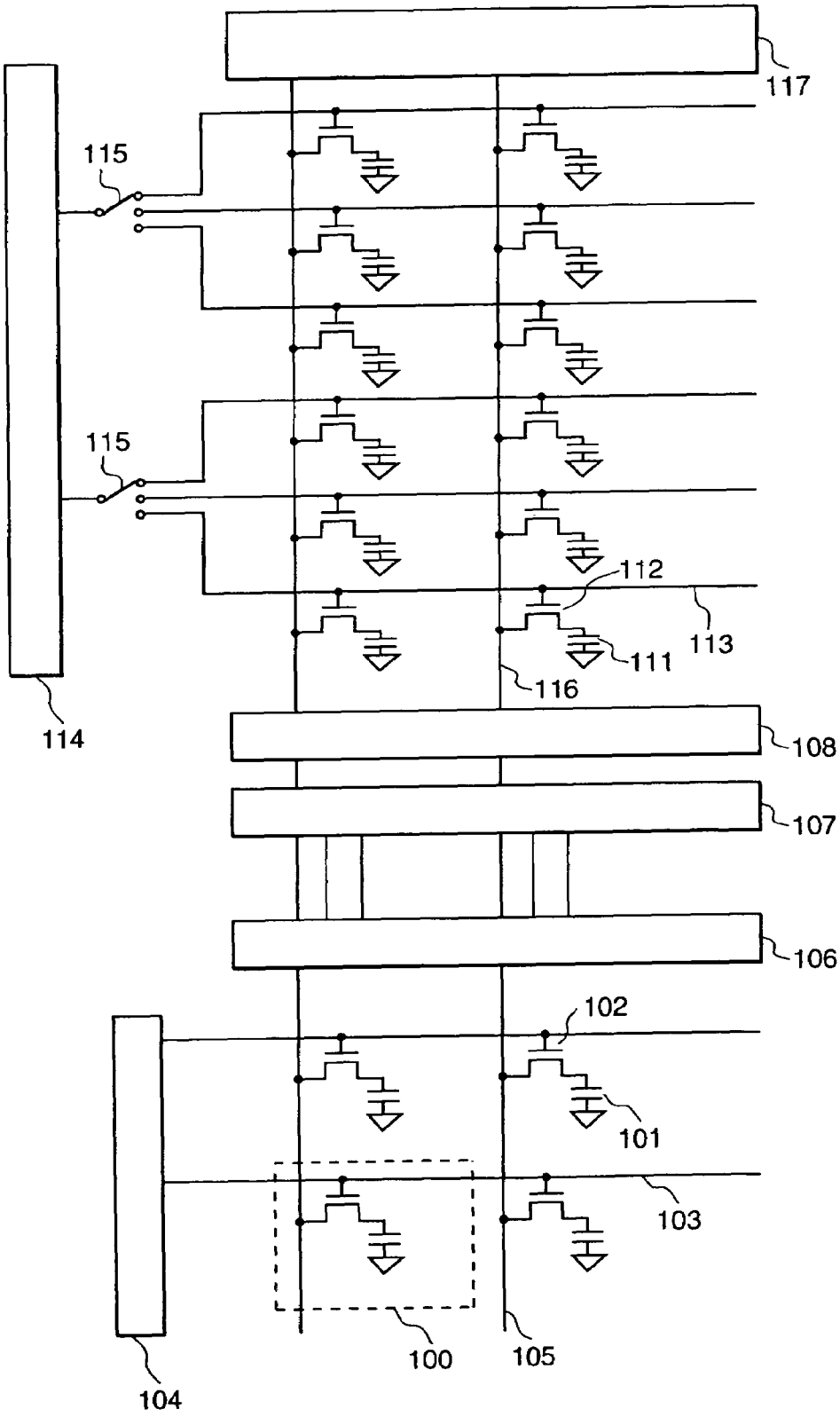
FIG. 19 is a schematic diagram showing the construction of a liquid crystal panel using a conventional technology.

An eighth embodiment in accordance with the present invention will be described below with reference to FIG. 18, which is a diagram showing the construction of an image browser.

Compressed image data is input from the outside to a wireless interface (I/F) circuit 87 as wireless data based on the bluetooth standard, and the output of the wireless I/F circuit 87 is connected to a frame memory 89 through a central processing unit (CPU) and decoder 88. Further, the output of the CPU and decoder 88 is connected to a row selection circuit 93 and a data input circuit 92 through an interface (I/F) circuit 91 provided on the polycrystalline Si liquid crystal display panel 90, and an image display area 94 is driven by the row selection circuit 93 and the data input circuit 92. Further, an electric power source 95 and a light source 96 are arranged in an image viewer 97. Therein, the polycrystalline Si liquid crystal display panel 90 has the same construction and the same operation as that of the first embodiment previously described.

The operation of the eighth embodiment will be described below. The wireless I/F circuit 87 acquires compressed image data from the outside, and transmits the data to the CPU and decoder 88. The CPU and decoder 88 respond to the operation of a user to execute driving of the image viewer 97 or decoding of compressed image data depending on necessity. The decoded image data is temporally accumulated in the frame memory 89, and the image data and the timing pulse for displaying the accumulated image are output to the I/F circuit 91 according to an instruction of the CPU and decoder 88. The I/F circuit 91 displays the image on the image display area by driving the row selection circuit 93 and the data input circuit 92 using these signals. Since this operation is the same as that described in the first embodiment, detailed explanation thereof will be omitted here. The light source 96 is a back light to the liquid crystal display, but the light source 96 does not need to be lighted when the liquid crystal display is operated in the reflecting mode. A secondary battery is included in the electric power source 95, and it supplies electric power for driving the whole apparatus.

According to the eighth embodiment, a high-quality image can be displayed with low power consumption based on compressed image data.

According to the present invention, it is possible to reduce consumed electric power of the image display apparatus.

What is claimed is:

1. An image display apparatus comprising:

a plurality of signal lines;

a plurality of display pixels arranged in a matrix to provide image display, each of said display pixels comprising a pixel electrode connected to said each of the plurality of signal lines via a pixel switch;

a plurality of data lines;

a plurality of memory cells for storing digital display data;

an image signal generating circuit for outputting an image signal to the signal lines based on said digital display data inputted from the plurality of memory cells via the data lines; and wherein each of the plurality of memory cells comprises a memory switch connected to one of said data lines; a memory capacitor connected to said memory switch; and a field-effect transistor of which a source-drain path thereof is provided between a first node and a second node coupled to a corresponding one of said data lines, wherein one electrode of said memory capacitor is connected to a gate of said field-effect transistor and another electrode of said memory capacitor is connected to said second node, and wherein when a memory cell is read or written, a predetermined voltage is supplied to said first node.

2. An image display apparatus according to claim 1, wherein each of said plurality of display pixels is a liquid crystal display pixel having a counter electrode and a liquid crystal region between said pixel electrode and said counter electrode.

3. An image display apparatus according to claim 2, wherein said plurality of display pixels have an optical reflecting plate.

4. An image display apparatus according to claim 2, wherein said image signal generating circuit has digital-to-analog converter for generating an image signal from said digital display data stored in said memory cell, and said digital-to-analog converter has a function of selectively outputting substantially two kinds of image signal voltages to the same digital display data.

5. An image display apparatus according to claim 1, wherein said plurality of display pixels, said plurality of signal lines and said image signal generating circuit are formed on a single transparent substrate.

6. An image display apparatus according to claim 5, wherein lighting means to the display pixels is provided on a surface of said transparent substrate opposite to the surface on which the display pixels, the plurality of signal lines and the image signal generating circuit are arranged, and black matrix shielding is arranged between said transparent substrate corresponding to back portions of said memory cells and said lighting means.

7. An image display apparatus according to claim 1, wherein said memory capacitor is a capacitor between a gate and a channel of said field-effect transistor.

8. An image display apparatus according to claim 1, wherein said memory capacitor is a capacitor between a gate and a channel of a polycrystalline Si thin-film transistor (poly-Si TFT).

9. An image display apparatus according to claim 1, wherein some of said memory cells are connected to one data line, and said second node is connected to said corresponding data line through a selection switch.

10. An image display apparatus according to claim 9, wherein said selection switch is a polycrystalline Si thin-film transistor (poly-Si TFT) which is diode-connected in which the drain and the gate thereof are directly coupled.

11. An image display apparatus according to claim 9, wherein said selection switch is a p-n junction diode using a polycrystalline Si thin film.

12. An image display apparatus according to claim 9, wherein said memory cells are arranged in a matrix along said data lines extending in a y-direction, and said data lines are arranged by n line units in a case where unit digital display data composed of n bits is stored by n of said memory cells.

13. An image display apparatus according to claim 1, wherein said image signal generating circuit has digital-to-analog converter for generating an image signal from display data stored in said memory cell.

* * * * *